US008726430B2

(12) United States Patent
Tran et al.

(10) Patent No.: US 8,726,430 B2
(45) Date of Patent: May 20, 2014

(54) PEDICURE SPA STATION WITH SEPARATE INTEGRATED DRAIN

(75) Inventors: Minh Sang Tran, Cambridge (CA); Christopher Alexander, Cambridge (CA)

(73) Assignee: Gulfstream Inc., Cambridge, Ontario (CA)

( * ) Notice: Subject to any disclaimer, the term of this patent is extended or adjusted under 35 U.S.C. 154(b) by 525 days.

(21) Appl. No.: 13/186,099

(22) Filed: Jul. 19, 2011

(65) Prior Publication Data

US 2013/0019394 A1 Jan. 24, 2013

(51) Int. Cl.
*A47K 3/022* (2006.01)

(52) U.S. Cl.
USPC ..... 4/622; 607/86; 607/111; 4/574.1; 4/621

(58) Field of Classification Search
USPC ..... 4/573.1, 574.1, 590, 622, 594, 621, 4/571.1, 480; 607/86, 111; 601/24, 30, 601/49, 86, 90, 98, 158, 157; 297/217.1, 297/182, 423.1, 423.11
See application file for complete search history.

(56) References Cited

U.S. PATENT DOCUMENTS

2006/0242760 A1* 11/2006 Chao ..... 4/622
2010/0301640 A1* 12/2010 Heiser ..... 297/135

* cited by examiner

*Primary Examiner* — Gregory Huson
*Assistant Examiner* — Lauren Heitzer
(74) *Attorney, Agent, or Firm* — Jones Walker LLP

(57) ABSTRACT

A pedicure spa station platform that includes a raised platform having a front and a rear, and a seat area on the top surface of the platform for attaching a seat or chair. The platform has a basin tray for holding a basin. The basin tray area is positioned in front of the seat mount location. A well entrance is located between the seat area and the basin tray. The well has a sidewall with a front portion and a back portion, and a drain positioned in the sidewall. The sidewall forms a rim near the front portion (the well entrance). A vertical riser is positioned in front of the basin tray, and the vertical riser terminates in a footrest, where the footrest extends in part over and above the basin tray. The foot rest is movable with respect to the raised platform.

12 Claims, 11 Drawing Sheets

PEDICURE SPA STATION WITH SEPARATE INTEGRATED DRAIN

BACKGROUND OF THE INVENTION

A pedicure spa station is a chair where a user rests and provides the needed equipment for a pedicurist—a basin (also referred to as a "spa basin") for water and additives, where the user may soak his/her feet, and a foot support where the user can rest his/her feet for access by the pedicurist. After one user has completed a pedicure, the spa basin should be emptied and cleaned for use by the next user. In general, either the spa basin has a drain in the bottom to allow drainage of the basin, or if lacking a drain, the spa basin must be moved to a discharge location remote from the spa station.

The first option is not optimal, as an integrated spa basin drain, after the spa is drained and cleaned, may hold skin shavings, nail shavings or other biological materials, and hence contaminate the basin and present a sanitary hazard for the next user. The second option, while more sanitary, requires the pedicurist to pick up the water filled basin and discharge it remotely. This causes physical stress on the pedicurist, and presents spill and contamination hazards.

DESCRIPTION OF THE PREFERRED EMBODIMENT

Figure 1:
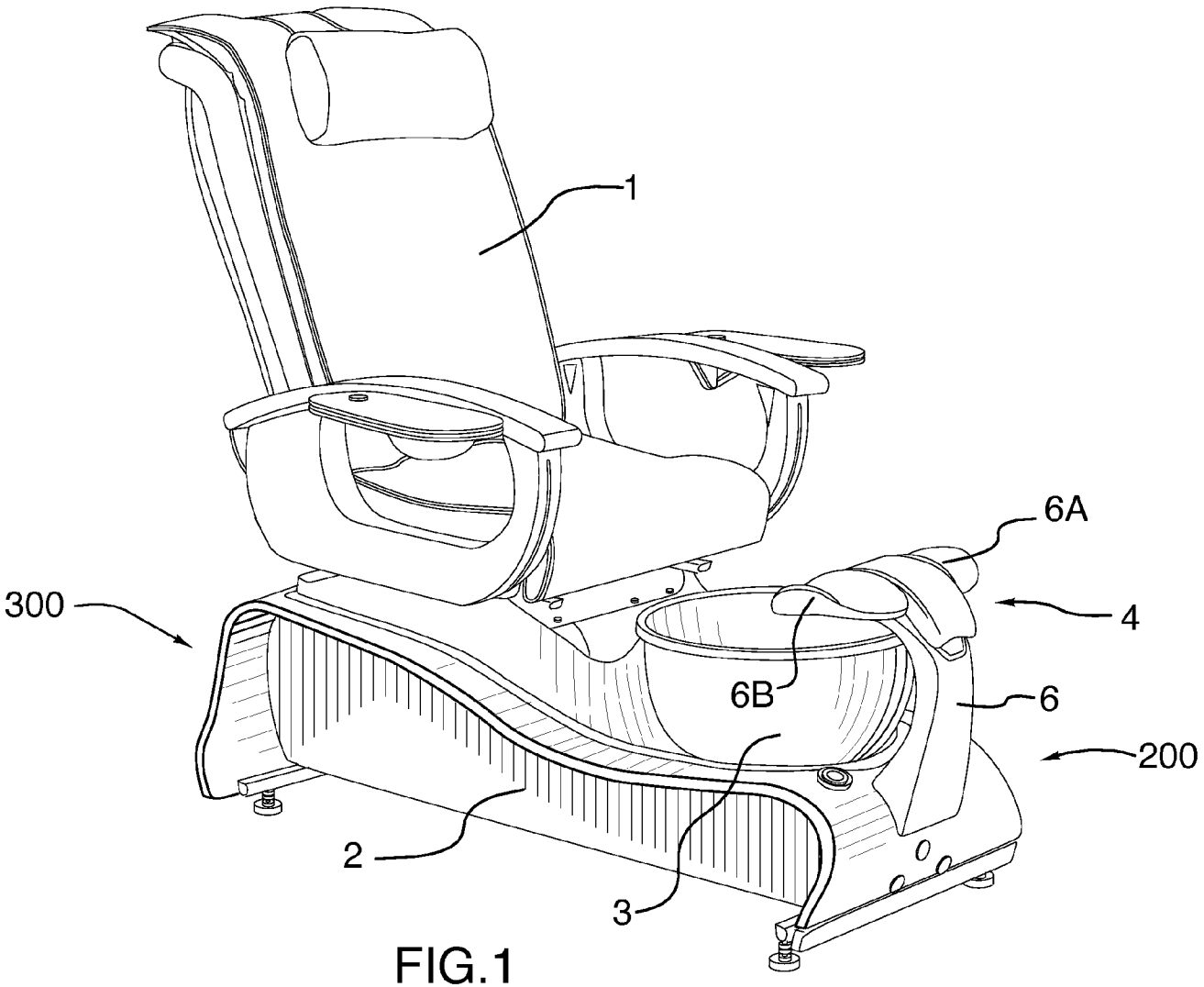
FIG. 1 is a perspective view of a spa station with an integrated drain.
Figure 5:
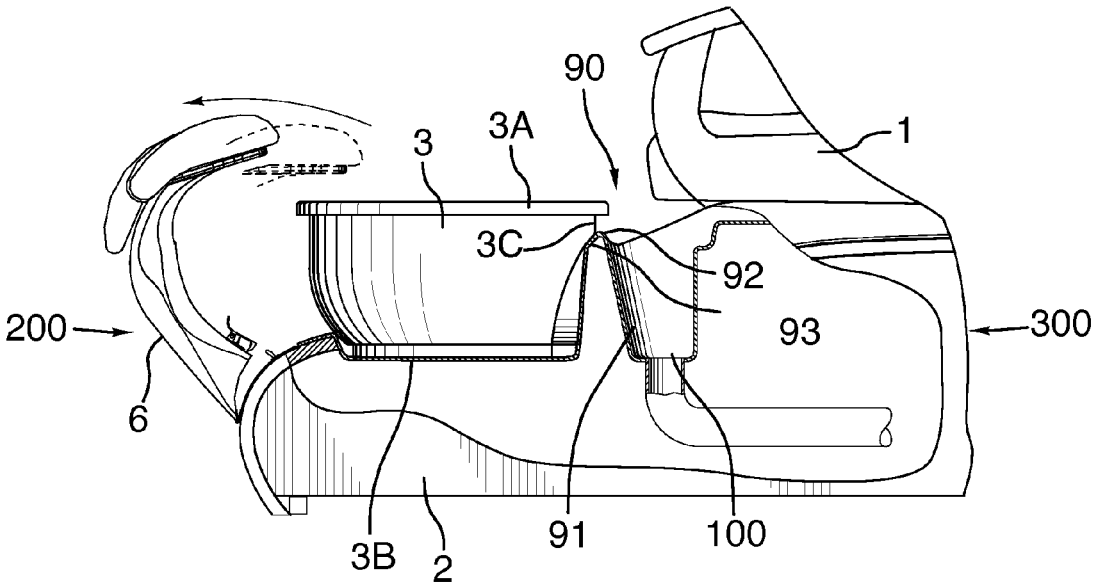
FIG. 5 is a partial side cutaway view of the spa station of FIG. 1.
Figure 6:
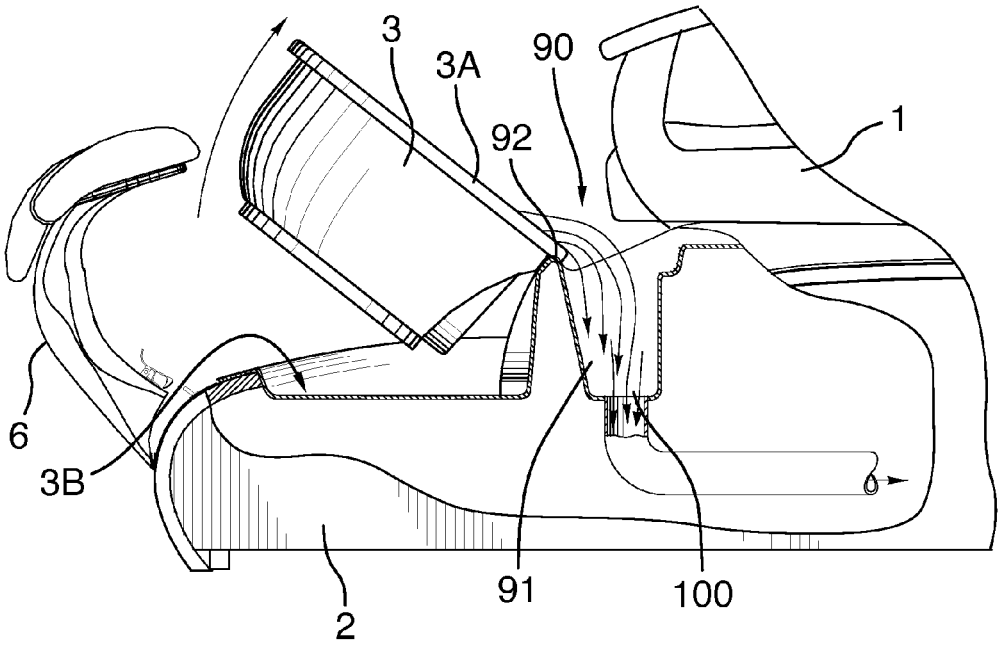
FIG. 6 is a partial side cutaway view of the spa station of FIG. 1 showing the bowl discharging into the well.

FIG. 1 shows a spa station comprising a chair or seat 1 positioned on a raised platform 2. Raised platform means that the top surface (the mounting surface, in general) of the platform is not completely at ground level, that the platform has at least a portion raised above the ground level, such as by a sidewall or legs. For reference, the front 200 of the station refers to that portion of the station closest to the footrest 6A and 6B (FIG. 1), while the rear 300 of the station refers to that portion of the station opposite the front 200. Reference to front and rear of other components of the station (such as the basin, drain well, etc.) are similarly defined. The platform has a basin tray 3B, an area in front of the chair 1 that is designed to accommodate and hold a spa basin 3. The basin tray area 3B may be shaped to mimic the shape of the spa basin 3 (e.g., bowl shaped), or be a flat area, such as shown in FIG. 5 and FIG. 6. The spa basin 3 is separate or separatable from the platform 2, that is, the spa basin 3 is not integrally formed in the platform and preferably can be removed from the platform. The basin 3 is bowl shaped to retain fluids, and preferably has no drain or other port. A liner may be used in the basin for sanitary purposes.

Figure 7:
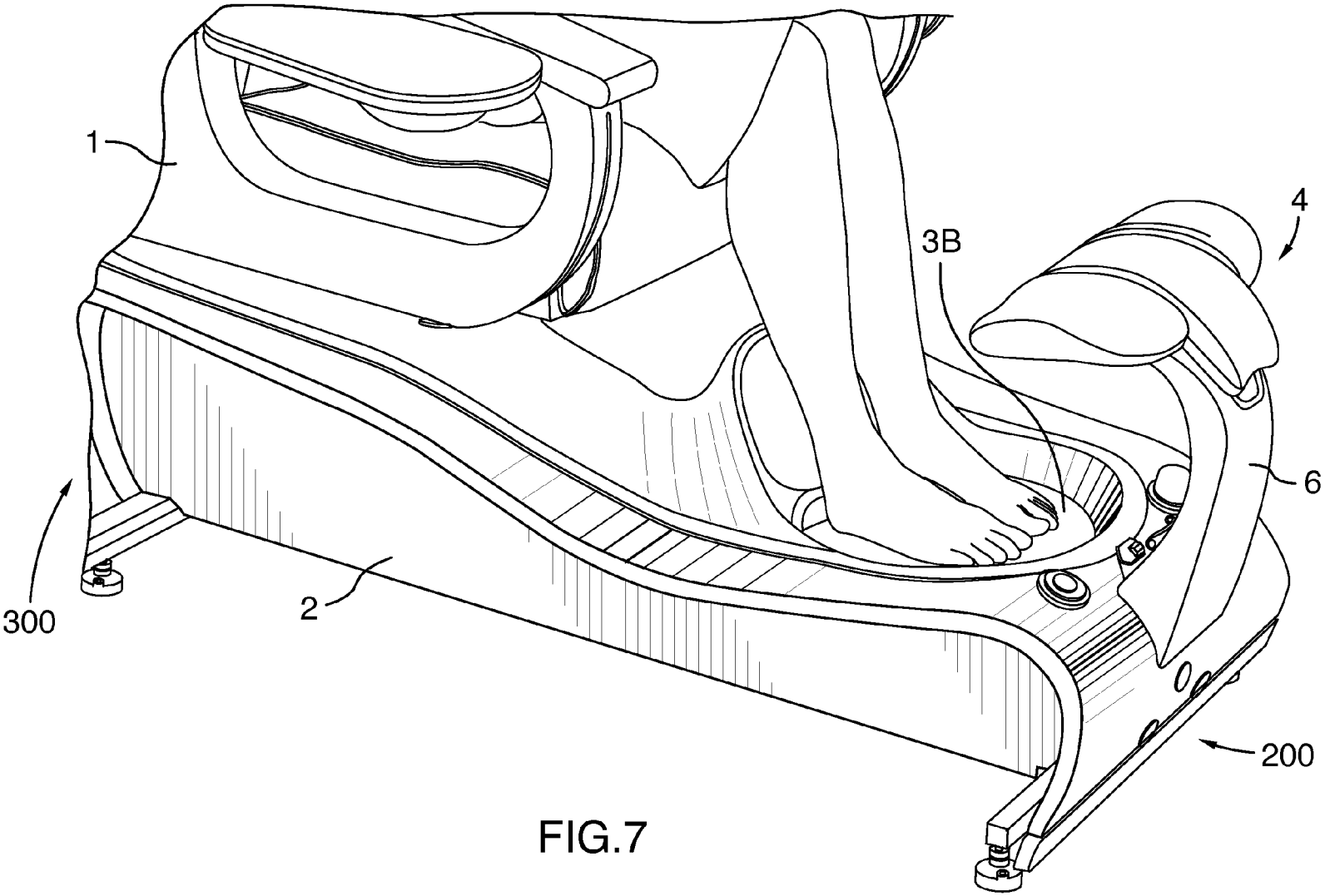
FIG. 7 is a prospective view of the embodiment of FIG. 1 showing the relationship of a users feet with the basin tray.
Figure 8:
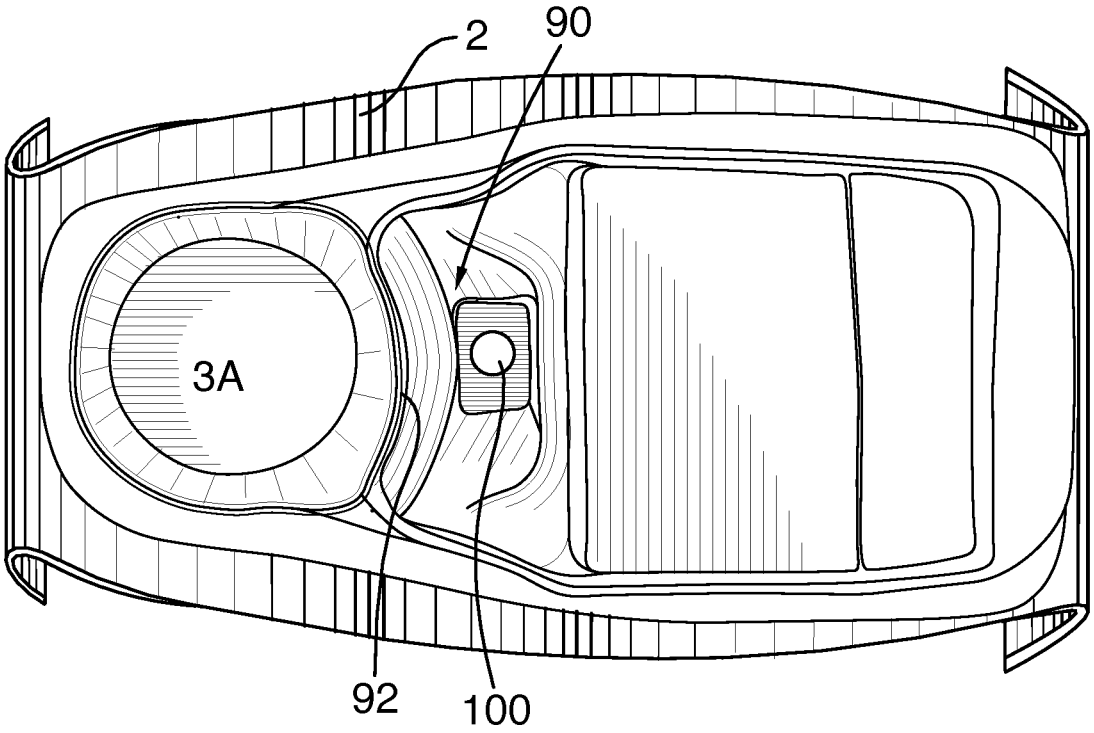
FIG. 8 is a top view of one embodiment of the pedicure platform.

The spa station may include a resistance coil or other heater positioned underneath or embedded in the basin tray 3B, or in a separate plate, such as in a heating pad in the tray area 3B, to provide additional heating therapy for a user's feet, as shown in FIG. 7. Also, a vibratory plate may be positioned in the tray area 3B for additional therapy.

Figure 2:
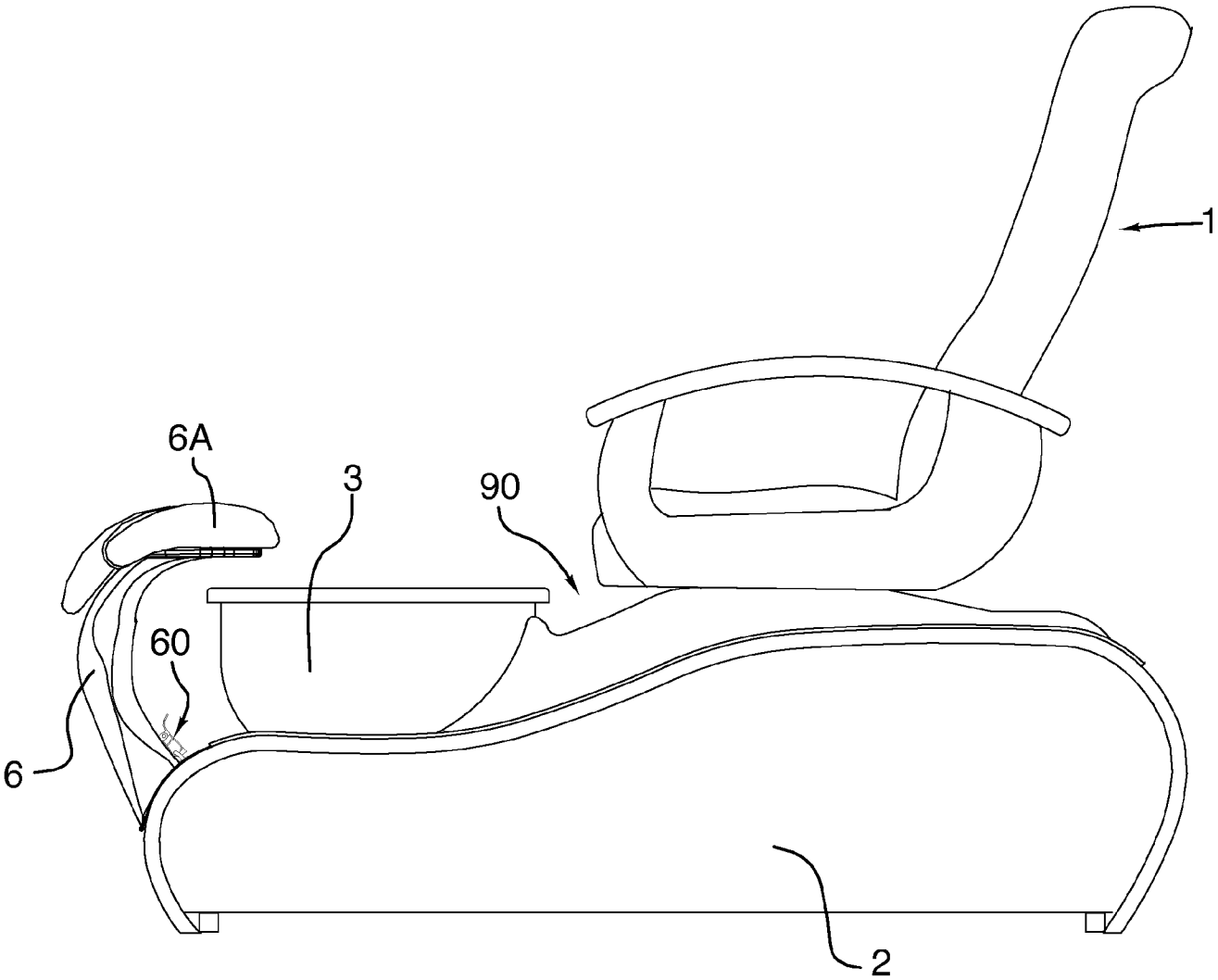
FIG. 2 is a side view of the spa station of FIG. 1.

Positioned in front of the basin 3 is foot support member 4. As shown, foot support member 4 has a vertical riser 6 formed in an arch shape. At the top of the arch is a laterally extending footrest 6A and 6B (FIG. 1), one on either side of the arch shaped vertical riser 6, to accommodate a left and right foot. The arch shape allows the footrest area 6A and 6B (FIG. 1) to be positioned in the front of and extending over a portion of the spa basin 3, as can be seen in FIG. 2. This allows for the natural position of a user's feet with respect to the chair 1, and provides a working area for the pedicurist.

Figure 3:
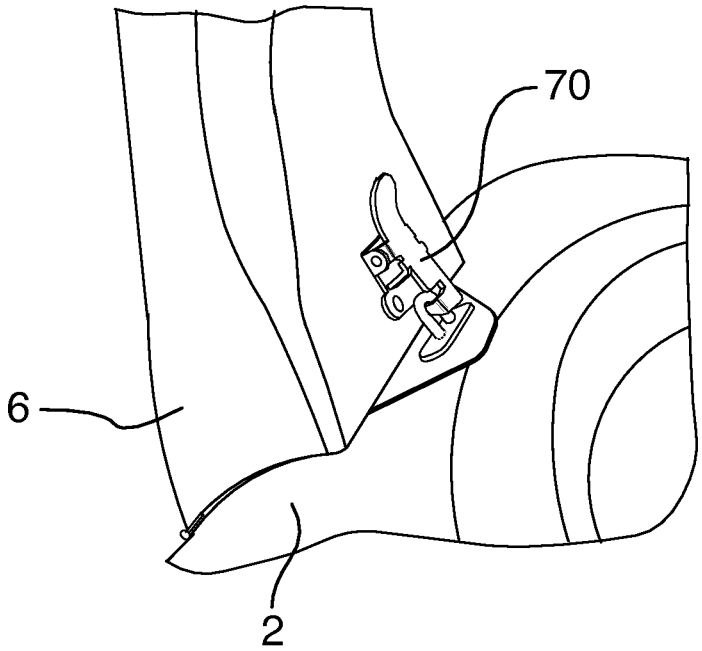
FIG. 3 is a detail perspective view of one embodiment of the riser latch.
Figure 4:
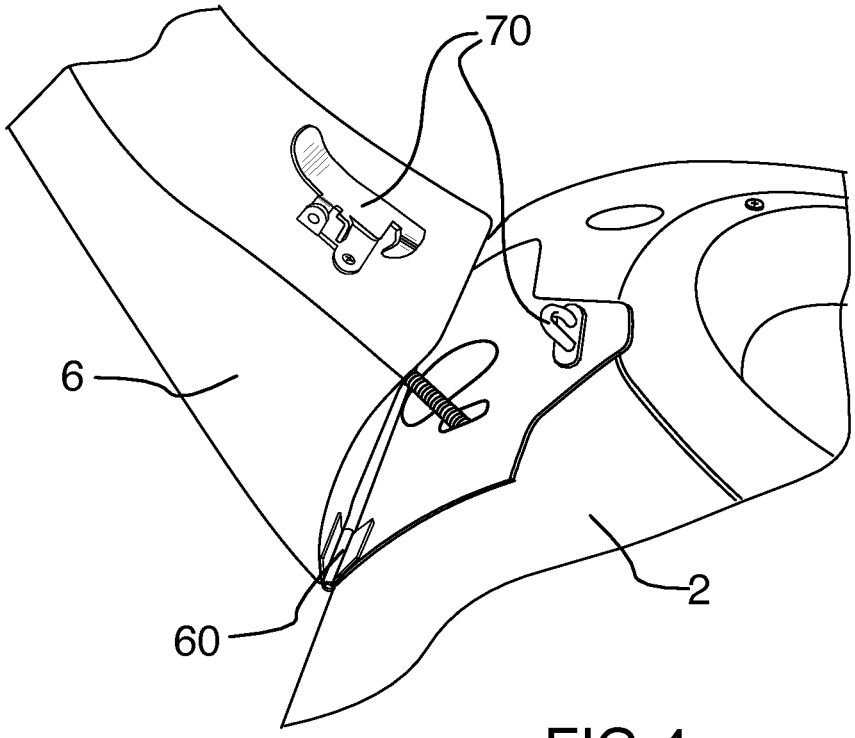
FIG. 4 is a detail perspective view of one embodiment of the riser, showing the hinge.

As shown in FIGS. 3 and 4, the foot support member 4 is hingedly connected to the platform by hinge 60, thereby allowing the foot support member 4 to rotate forwardly so that the foot support area 4 can be moved out of the path of the spa basin 3 when emptying the basin (later described), as best seen in FIG. 5 and FIG. 6. The spa station also has a latch member 70 to lock the vertical riser 6 to the platform 2. If the spa station does not have a foot support or foot rests (not preferred), the integrated drain may be located in front of the basin.

As shown, the vertical riser 6 is hingedly connected to the platform 2. Another embodiment would have the footrest area hingedly connected to the vertical riser 6, or have the vertical riser 6 formed from a top section and a bottom section, where the two sections are hingedly joined. Additionally, instead of a hinged vertical joint, the vertical riser 6 may pivot horizontally with respect to the platform 2, allowing the riser 6 to rotate in a horizontal plane and out of the path of the basin 3 when discharging the basin's contents. Instead of a hinged or rotative attachment, the footrest may be in a telescoping relationship with the vertical riser, allowing the footrest to telescope out of the way of the path of the basin during discharge. Alternatively, the footrest or vertical riser may simply be detachable, or in some embodiments, lacking.

Positioned in front of the chair 1 and behind the spa basin tray 3B is a drain area 90. If the spa station is formed from molded plastic materials, the drain area 90 may be integral to the base 2. The drain area is formed by a sidewall 91 that creates a well with a well bottom, and has a drain 100 located in the well bottom. Preferably, the well is deep enough to accommodate a sufficient amount of water to prevent overflowing of the drain area 90 when discharging the contents of the spa basin 3. The drain area 90 (also referred to as a well)

is preferably large enough to allow a user to access the well to clean the drain to remove any materials that may impede flow through the drain 100. The drain connects to plumbing underneath the platform area that supports the chair, which plumbing can be connected to a suitable discharge site.

Figure 6A:
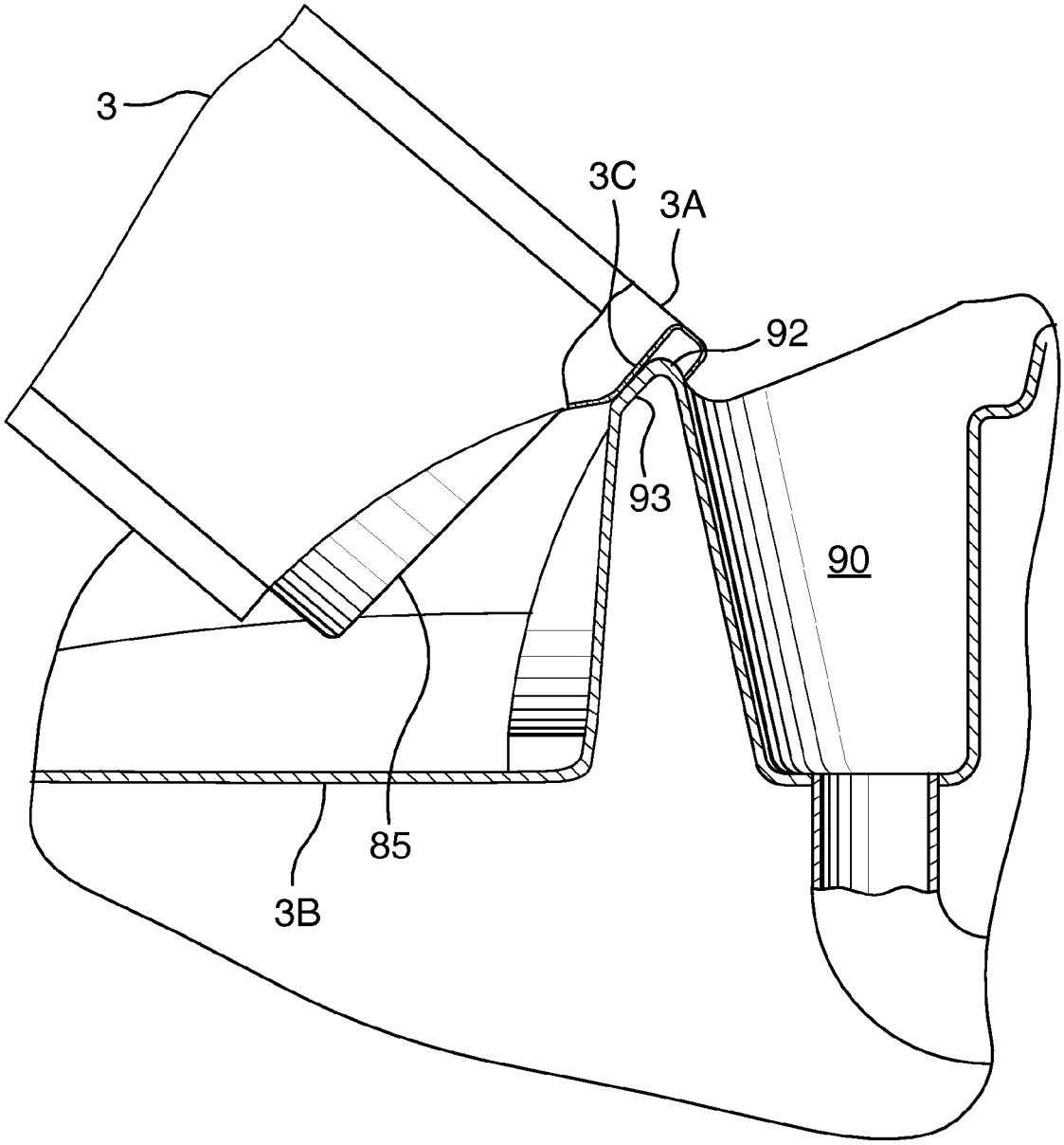
FIG. 6A is a detail perspective view of one embodiment of the shaped rim and lip.

The drain sidewall 91 extends upwardly and forms a rim 92 in the front of the well (that is adjacent the basin 3 and slightly below the lip 3A of the spa basin 3 when the spa basin is resting on the basin tray 3C). The rim 92 may be shaped in a region adjacent the spa basin 3 to accommodate the lip or edge 3B of the spa basin 3 in order to support the spa basin 3 when emptying the basin, such as shown in FIGS. 2, 5 and 6. As shown, the basin 3 has a lip 3A that extends outwardly from the bowl shape of the basin 3. Also as shown in FIG. 6A, the basin has an orientation, that is, the basin is shaped so that one portion is designed or intended to be positioned adjacent the well 90. In the basin embodiment of FIG. 6A, the "rear" of the basin is that portion that contains a flat area 85 designed to rest adjacent the sidewall of the well. In this event, the lip or edge 3A of the bowl only near the drain is of concern. If the bowl has no orientation, that portion of the edge of the bowl that is shaped to cooperate with the rim 92 of the drain will create a bowl orientation, or if the entire surrounding basin edge is similarly formed, the basin has no orientation with respect to the drain. Below the lip 3A is a flat area 3C on the bowl. The rim 92 of the drain adjacent the bowl 3 has a similar flat 93, and the rim's thickness is sufficient to allow the lip 3A of the basin to extend beyond the sidewall 91 of the drain during discharge. The details of the rim and lip are more clearly shown in the detail of FIG. 6A. The rim 92 as described is located as a portion of the front edge of the sidewall 91 forming the well, and the lip 3A, as described, is located on the rear of the spa basin 3 when positioned on the basin tray 3B. As such, if the lip 3A continues around the bowl, or the rim 92 continues around the well, the shapes of these features remote from the area of contact between the rim and lip during discharge do not have to be any particular shape.

In another embodiment, a hinged basin support may be attached to the platform to support the bowl during a discharge, or be formed in the platform. For instance, a single hinged "L" shaped bracket, where the bottom of the "L" is an annular ring, may be used, with the top of the "L" hingedly attached to the sidewall of the drain area 91 (such as centered on the discharge site). The annular ring may be sized to allow the basin 3 to rest inside the annulus (such as underneath the lip 3A of the basin, if the basin has a protruding lip), or be sized smaller then the bottom of the basin, to support the basin 3 on the bowl bottom of the basin. Instead of the bottom of the "L" forming an annular ring, the bottom of the "L" may simply form a ledge on which the basin bottom rests. If this type of hinged basin support is utilized, the rim shape 92 and lip 3B of the bowl do not need to be formed for cooperative support, as the hinge supports the basin. Instead of a single hinged arm, a double hinged arm could be employed, with each arm rotatively connects to the sidewall of the well or other suitable location, and each arm connects to the bottom basin support—such as an annular ring, or plate, or other basin support.

Figure 9A:
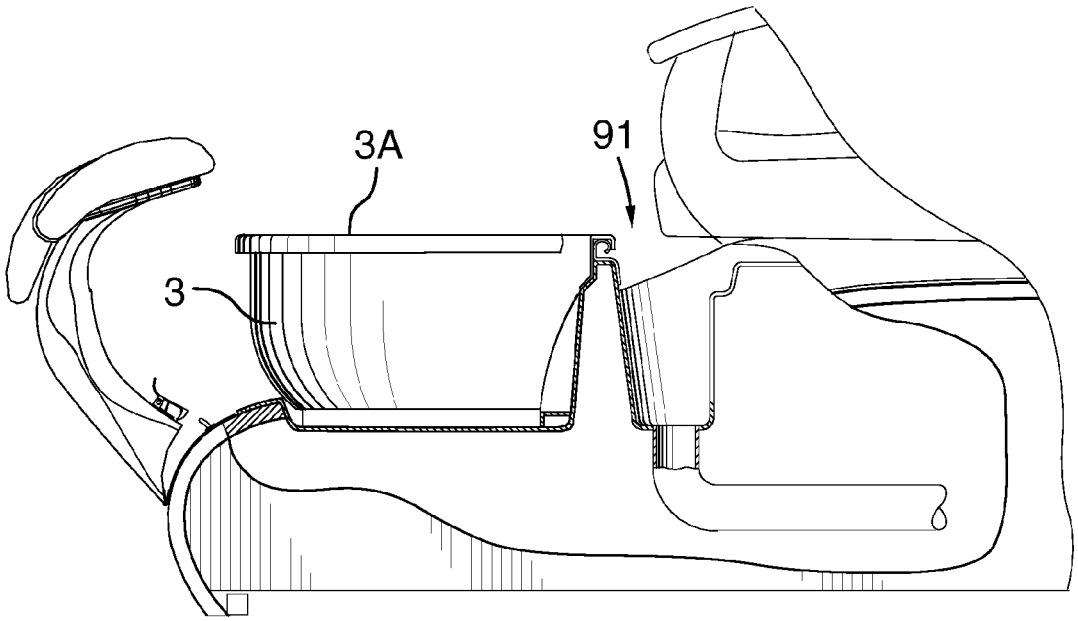
FIG. 9A is a partial cutaway prospective view of a pedicure station where the lip of the basin and rim of the well cooperate to rotatively support a basin during a discharge event.
Figure 9B:
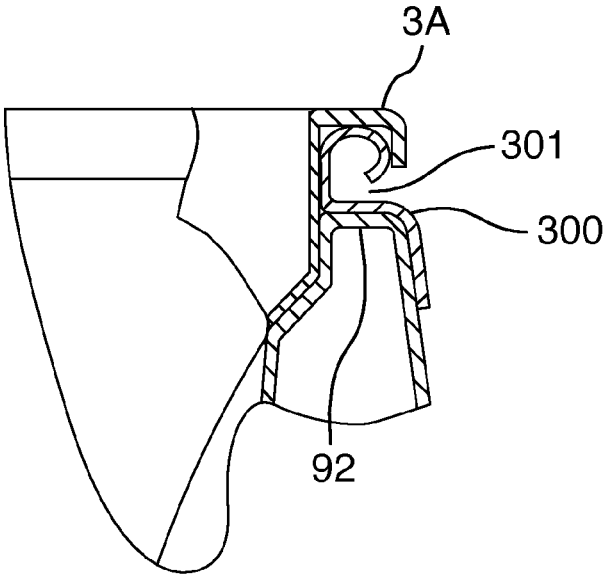
FIG. 9B is a detail of the cooperating areas of FIG. 9A.
Figure 10A:
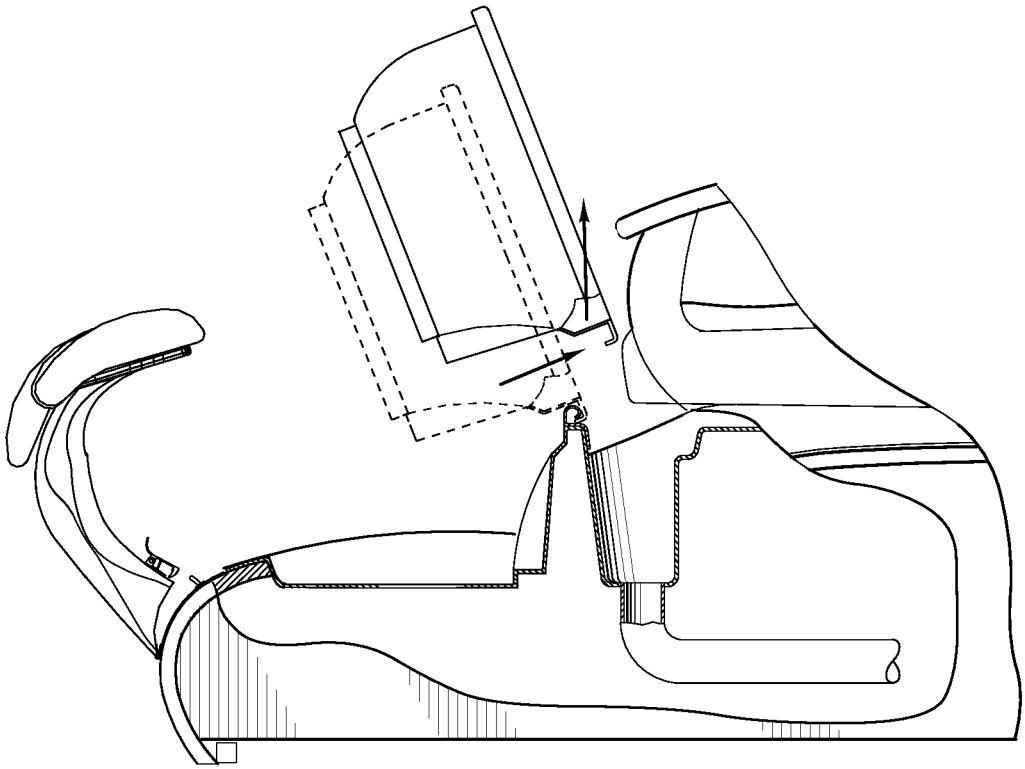
FIG. 10A is a prospective partial cutaway view of a spa station detailing the inter-relationship of the two cooperating areas of FIG. 9.
Figure 10B:
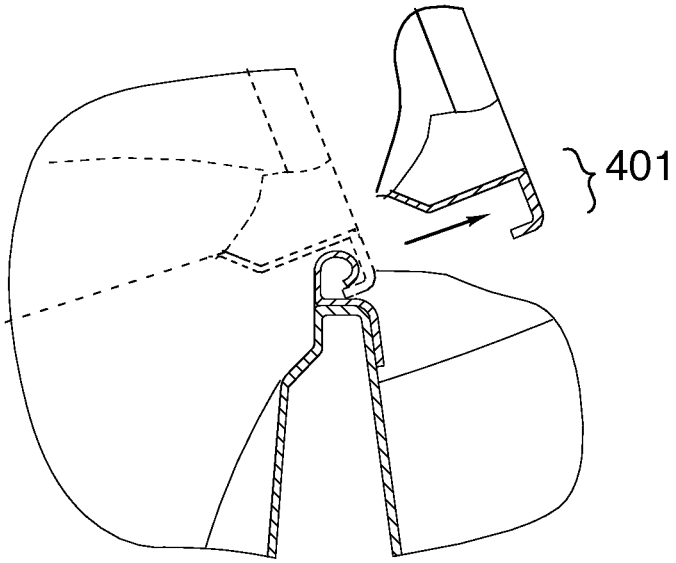
FIG. 10B is a detail of the two cooperating areas of FIG. 10A.

Another embodiment of a hinged basin support is shown in FIGS. 9A and 9B. As shown, the rim 92 of the drain area 91 may be shaped to cooperate with the shape of the basin lip 3A to rotatively (e.g., hingedly) support a basin 3 during a discharge event. Alternatively, a drain bracket 300, shaped for hingedly supporting the basin, may be attached to the platform to provide a suitable rotating support for the basin 3. As shown, the drain bracket 300 is attached to the drain area 91, with top of the bracket 300 forming an open cylindrically shaped barrel area. The basin lip 3A may be formed to rotate on drain bracket 300 (or on formed rim 92). As shown in FIGS. 10A and 10B, a hinge pin is not needed to join the two cooperating areas together (e.g., rim and bowl), but a pin or other connector could be used if a more fixed relationship was desired.

As shown in FIGS. 10A and 10B, in a discharge movement, the lip 3A and basin rim 92 are shaped (or have a separate bracket) to cooperate together to rotatively support the basin during discharge into drain 91. As can be seen, the lip 3A of the bowl is a "U" shaped region 401, and rests on the open barrel shaped area 301 on the basin rim 92. The open edge 301 of the barrel shaped area accommodates the edge of the "U" shaped lip 3A during discharge (as best seen in the detail of FIG. 10B).

Figure 11A:
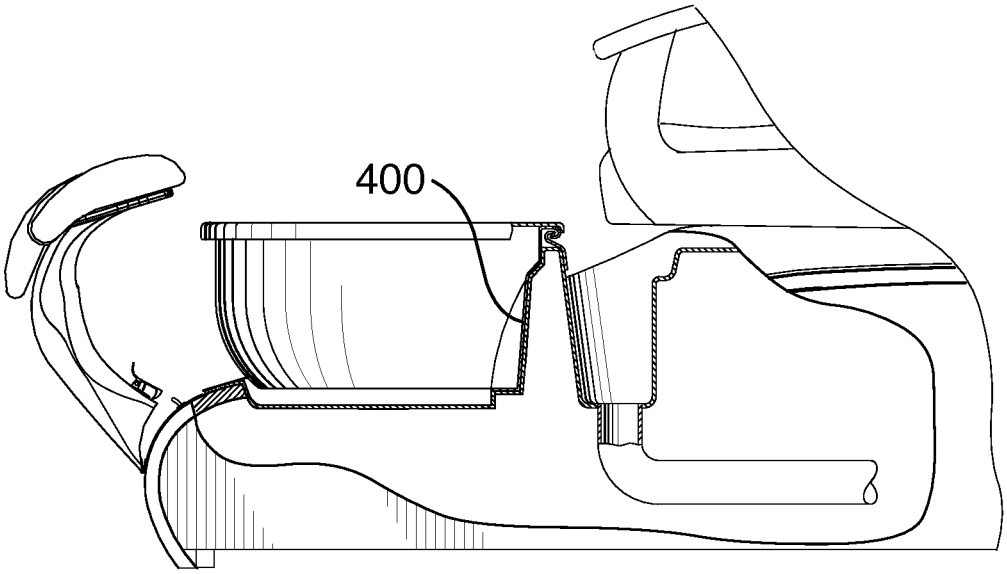
FIG. 11A is a partial cutaway prospective view of a pedicure station showing another embodiment where the lip of the basin and rim of the well cooperate to rotatively support a basin during a discharge event.
Figure 11B:
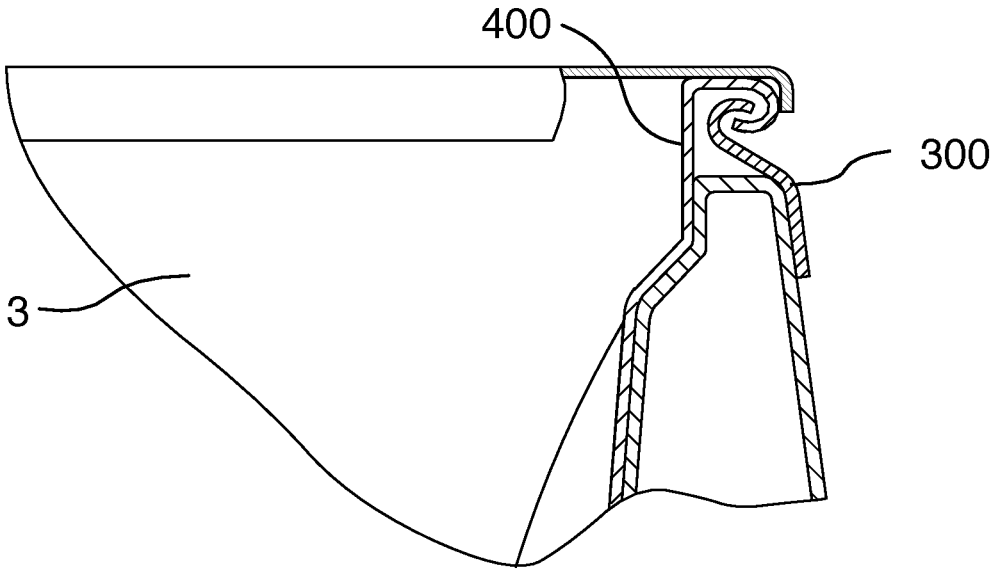
FIG. 11B is a detail of the two cooperating areas of FIG. 11A.
Figure 12:
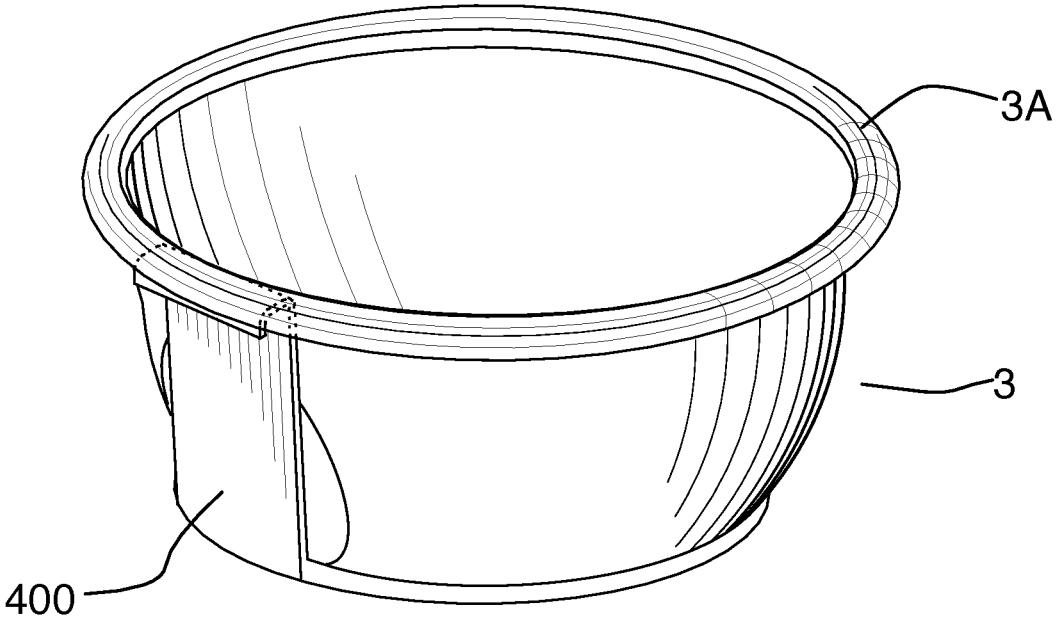
FIG. 12 details a bracket attached to one embodiment of the basin for rotative support.

Another embodiment of a hinged basin support is shown in FIGS. 11A and 11B. In this embodiment, a basin bracket 400 is attached to the basin 3, adjacent the discharge side of the basin (basin bracket 400 can best be seen in FIG. 12). As shown in FIG. 11B, the basin bracket 400 is positioned underneath the lip 3A of the basin 3. The basin bracket 400 is shaped to cooperate with either the rim 92 of the drain 91 sidewall, or as shown, on a separate drain bracket 300 positioned on the drain rim 92, to hingedly support the basin during a discharge event (e.g., when the bowl is rotated upwardly and rearwardly to discharge into the drain on the platform).

As described, the basin edge and rim of the well may cooperate to form a supporting hinged area for the basin to discharge into the well. Also as described, a separate hinge or rotation support may be provided to allow the basin to discharge into the well, where the edge or lip of the bowl and rim of the well do not cooperate, thus allowing for bowl variations.

In use, the spa basin 3 is filled with water and additives. After use by a user, the spa basin 3 is emptied by rotating the spa basin 3 upwardly and rearwardly, adjacent the drain sidewall 91. In the embodiment shown in FIGS. 5 and 6, the lip 3A of the basin 3 extends over the rim 92 of the drain sidewall 91. The contents of the spa basin 3 will empty into the drain area 90, and the waters are drained though pipes connected to the drain 100 to a suitable discharge location for disposal. Rotation of the basin 3 continues until the basin 3 is empty. If the hinged basin support is present, this action entails rotating the spa basin 3 about the hinged basin support hinge. The hinged basin support guides and helps supports the filled basin, allowing draining of the basin with little physical effort. An axially-coiled spring may be incorporated in the hinged basin support for enhanced lift assist.

If the basin support member is absent, then preferably the rim of the drain sidewall and the lip 3A of the basin 3 are shaped to accommodate one another so that the spa basin is rotated toward the drain area, the rim of the drain area will support and help guide the rotating spa basin. Additionally, the spa basin may have a vertical flat area 3C that faces the drain sidewall 91 to support the spa basin 3 when discharging the contents of the basin 3 into the drain well.

As described, the drain 100 is located adjacent the basin and built into the chair support. The spa station is designed to allow a pedicurist to discharge the contents of the spa basin with little effort, and maintain a more sanitary environment for a user. The integrated nature of the well and the cooperating hinged basin support helps prevent the discharged contents from spilling back into the basin.

The invention claimed is:

1. A pedicure station platform comprising a raised platform having a front and a rear, a seat area on said platform adapted to hold a seat; a basin tray adapted to support a basin, said basin tray positioned in front of said seat area; a well having a sidewall having a front portion and a back portion, and a drain positioned in said sidewall, said sidewall forming a rim near said front portion, said rim positioned between said basin tray and said seat area on said pedicure station platform; a vertical riser positioned in front of said basin tray, said vertical riser terminating in a footrest, said footrest extending in part over and above said basin tray, said height of said vertical riser being sufficient to allow a spa basin to rest in said basin tray with said footrest extending above the spa basin, said footrest being moveable with respect to said raised platform.

2. The pedicure station platform of claim 1 where said footrest is movable with respect to said platform by having said vertical riser rotatable with respect to said platform.

3. The pedicure station platform of claim 2 where said vertical riser is hinged to said platform to rotate in the direction of rear to front of said platform.

4. The pedicure station platform of claim 3 further comprising a latch to lock said vertical riser in place with respect to said platform.

5. The pedicure station platform of claim 1 further having a separate spa basin, said spa basin forming a bowl without ports in said bowl, said spa basin having a lip near the rear of said spa basin when positioned on said basin tray, said spa basin sized to rest on said basin tray, where said lip is vertically positioned above said rim of said sidewall.

6. The pedicure station of claim 5 where said rim is shaped to support said spa basin lip when said bowl is rotated upwardly and rearwardly.

7. A pedicure station platform comprising a raised platform having a front and a rear, a seat area on said platform adapted to hold a seat; a basin tray adapted to support a basin, said basin tray positioned in front of said seat area; a basin formed to hold fluids, said basin having an edge portion; a well positioned on said platform said well having a sidewall having a front portion and a back portion; a drain positioned in said sidewall, said sidewall forming a rim near said front portion, said rim positioned between said basin tray and said seat area on said raised platform; a hinged basin support positioned on said platform, said hinged basin support adapted to rotatively support said basin positioned on said basin support, to allow said basin to rotate and discharge into said well.

8. The pedicure station of claim 7 wherein said hinged basin support comprises a first area of said basin edge and a second area of said sidewall, where said first and second areas cooperate to hingedly support said basin during a basin discharge event.

9. The pedicure station of claim 7 wherein said hinged basin support comprises a first bracket, said first bracket coupled to said platform near said sidewall of said well, where said first bracket is shaped to cooperate with said basin edge to hingedly support said basin during a basin discharge event.

10. The pedicure station of claim 7 wherein said hinged basin support comprises a second bracket, said second bracket coupled to said basin, where said first bracket is shaped to cooperate with said sidewall rim hingedly support said basin during a basin discharge event.

11. The pedicure station of claim 7 wherein said hinged basin support comprises a first bracket, said first bracket coupled to said platform near said sidewall of said well, and a second bracket, said second bracket coupled to said basin, where said first bracket and said second bracket are shaped to cooperate with each other to hingedly support said basin during a basin discharge event.

12. A method of discharging a spa basin in a pedicure station platform where the pedicure station platform comprises a raised platform having a front and a rear, a seat area on said platform adapted to hold a seat; a basin tray adapted to support a basin, said basin tray positioned in front of said seat area, a well positioned between said basin tray and said seat area on said pedicure station platform, said well having a sidewall having a front portion and a back portion, and a drain positioned in said sidewall, said sidewall forming a rim near said front portion; a vertical riser positioned in front of said basin tray, said vertical riser terminating in a footrest, said footrest extending in part over and above said basin tray, said height of said vertical riser being sufficient to allow a spa basin to rest in said basin tray with said footrest extending above the spa basin, said footrest being moveable with respect to said raised platform; and a separate spa basin having liquid materials disposed in said basin, said spa basin resting on said basin tray;

said method comprising the steps of lifting said spa basin upwardly and rotating said spa basin rearwardly with respect to said basin tray to direct the liquids in said spa basin into said well.

* * * * *